United States Patent [19]

Walters

[11] 4,376,521

[45] Mar. 15, 1983

[54] GLASS SHELF SUPPORT

[76] Inventor: Max Walters, 4351 Boardwalk Dr., Apt. 306, Huntington Harbor, Calif. 92649

[21] Appl. No.: 163,944

[22] Filed: Jun. 30, 1980

[51] Int. Cl.[3] ..... F16B 47/00

[52] U.S. Cl. ..... 248/206 R; 108/152; 211/90; 248/235

[58] Field of Search ..... 248/235, 206 R, 247, 248/248; 211/90; 108/152, 108

[56] References Cited

U.S. PATENT DOCUMENTS

| | | | |
|---|---|---|---|
| 897,076 | 8/1908 | Eustis | 211/90 X |
| 1,224,127 | 5/1917 | Bartlett | 211/90 |
| 3,669,395 | 6/1972 | Gehrke | 248/235 |
| 3,750,991 | 8/1973 | Ragir | 248/206 R |

FOREIGN PATENT DOCUMENTS

| | | | |
|---|---|---|---|
| 168899 | 7/1934 | Switzerland | 211/90 |

*Primary Examiner*—William H. Schultz
*Assistant Examiner*—Ramon O. Ramirez

[57] ABSTRACT

A bracket for supporting a shelf extending outward from a wall has a top member with a surface of receiving the shelf. The top member has an end proximal to the wall and an end distal to the wall. One or more suction cups attach to the proximal end and suspend the device from the wall. The top member has a supporting web which depends inward away from the distal end extending into an elongate foot portion which abuts the wall. The top member is supported by a suction cup near its proximal end and by the foot portion which is of a sufficient length to permit wall abutment when the top member is in a substantially horizontal position, and is also spaced a sufficient distance below the point of attachment of the suction cup to prevent the cup from interfering with the wall abutment of the foot.

5 Claims, 6 Drawing Figures

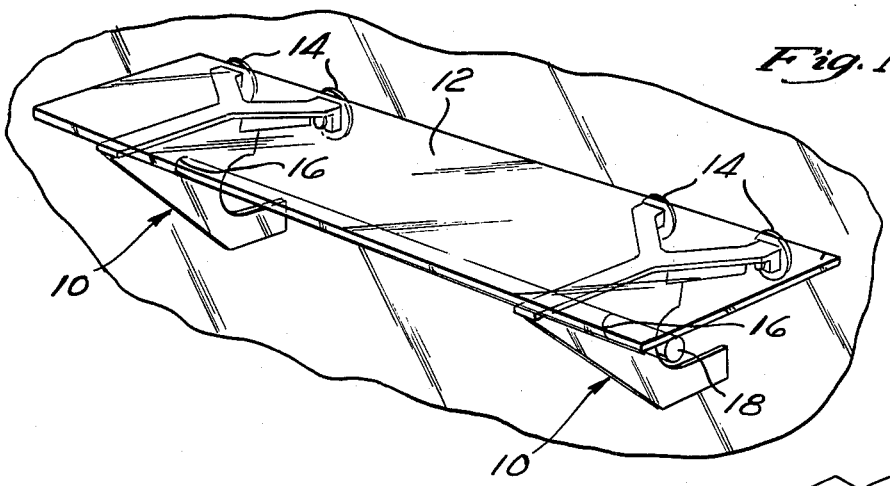
Fig. 1
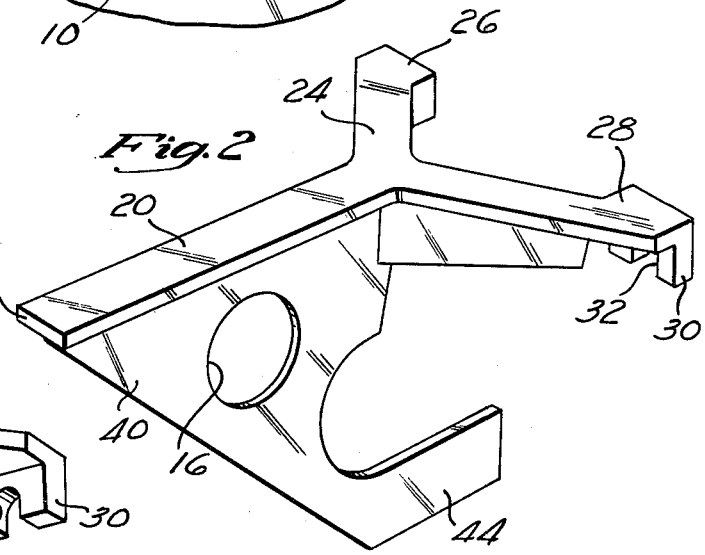
Fig. 2
Fig. 3
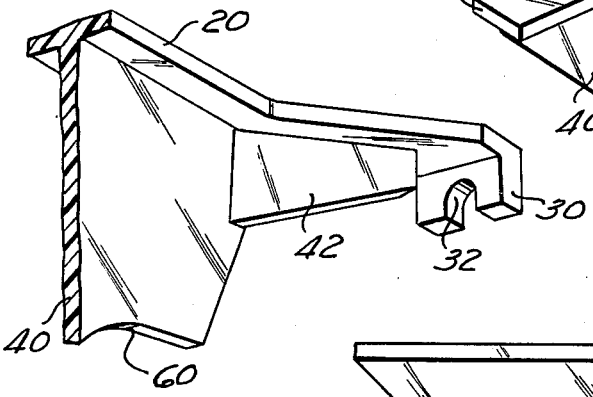
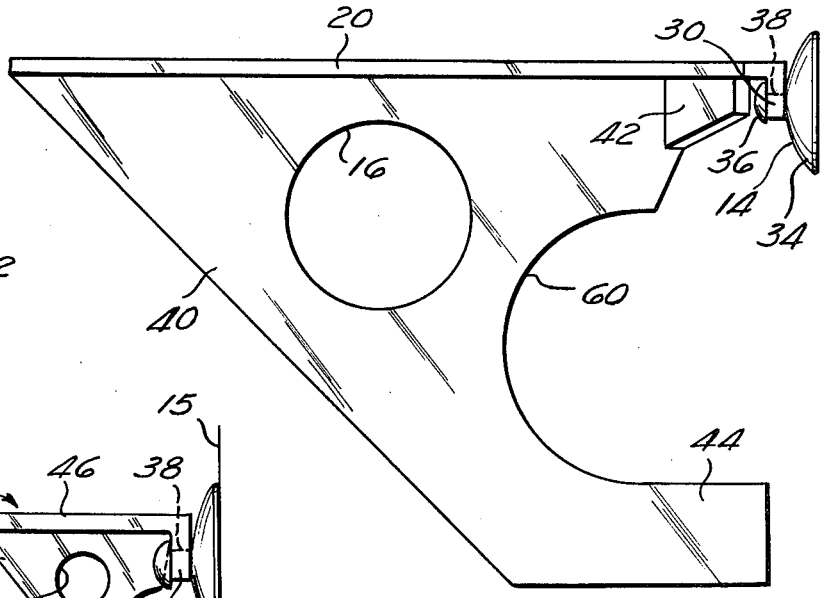
Fig. 4
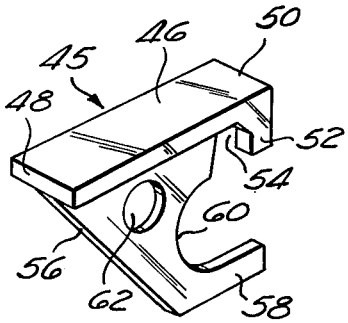
Fig. 5
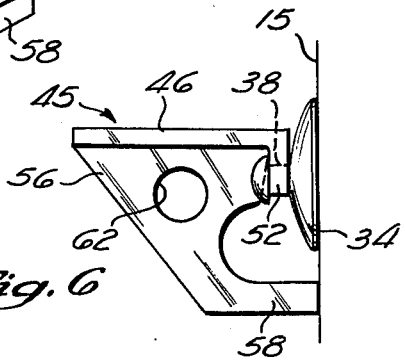
Fig. 6

GLASS SHELF SUPPORT

BACKGROUND OF THE INVENTION

The invention is generally directed to supports for shelves which extend horizontally outward from a vertical wall and more specifically to plastic or glass shelves which are typically used in store front windows to display various goods.

It is well known to support a horizontal shelf by using metal brackets which project outward from a wall and are fastened to the wall by means of screws, nails, tacks, hooks, and the like. Such shelf supports offer the strength needed to display heavier items, however, the fastening means, such as screws, damage the wall and make it difficult to change the position of the shelf. Thus, such shelves become a somewhat permanent fixture.

In order to prevent physical damage to the wall, fastening means such as glue and tape have been used to support the brackets. However, such fastening means do not offer the strength necessary to hold heavier items. Moreover, such shelves are not easily movable to different positions on the wall.

A degree of vertical adjustability can be attained by employing metal rails containing vertically stacked slots to receive the brackets. Thus, the shelves can be moved vertically up or down by positioning the brackets within different slots on the rails. However, the rails must be affixed to the wall usually by fastening means such as screws, which, again, physically damage the wall. In addition, the shelves are only adjustable within the relatively small area defined by the vertical rails.

Since the above described shelf supports are normally made of metal, when they are used for supporting glass shelves, the supports are easily visible through the shelf, detracting from the physical appearance of the display. In addition, such shelves have a tendency to be fairly heavy and manufactured at a relatively high cost.

It is also known to suspend metal hooks or screws by means of a suction cup which has a cap that is attached to the wall. Such hooks and screws are then used to support light articles such as signs which indicate whether the store is open or closed and the store hours. One prior device employs a transparent suction cup which suspends a transparent ring that is used to hold a flower vase. Such devices suffer the disadvantage that since they are suspended only by the suction cup, they offer minimal support and are incapable of supporting heavier items.

There is, therefore, a significant need for a simple, lightweight shelf support which can be manufactured at low cost. In addition, the shelf support must be easy to put up and take down without damage to the wall, and yet must possess sufficient strength to support heavier goods typically displayed in store windows, such as shoes, and the like.

SUMMARY OF THE INVENTION

The disclosed invention obviates the disadvantages possessed by the prior support shelf devices. The inventive device has a top member having an end proximal to the wall and an end distal to the wall. The top member forms a surface suitable for receiving a horizontally positioned shelf. The top member has one or more yoke-like projections which extend downward from the proximal end essentially parallel to the wall, each forming a recess. The support device is suspended from the wall by means of one or more suction cups which have a cap portion for engaging the wall and a neck portion sized to fit snugly within each of the recesses of the yoke-like projections.

The top member has a supporting web which depends downward from and essentially perpendicular to the top member. This web has a foot for abutting the wall formed by a hollowed portion between the foot and the yoke-like projection. This foot offers the strength necessary for the shelf to support heavier items, such as shoes.

The foot extends inward essentially as far as the cap portion of the suction cups when the cup is positioned within the projection to permit the foot to abut the wall when the suction cup is engaged with the wall. The foot is spaced a sufficient distance from the projection to prevent the cup from interfering with the wall abutment of the foot.

The suction cups themselves are known in the prior art and are made of a relatively flexible soft plastic material while the remainder of the support device is composed of a more rigid plastic. Advantageously, all elements of the device are transparent. The device is therefore simple, light in weight, and can be manufactured at low cost. The fact that the materials are transparent makes the device especially suitable for use with glass shelves for displaying goods. Use of the glass shelf with a transparent support device as described provides the illusion that the goods are freely suspended in air. Such displays are quite aesthetically pleasing to the consumer and focus the full attention of the consumer toward the goods themselves.

The use of the suction cups to suspend the shelf allows the shelf to be easily put up and taken down and easily positioned to any desirable location on the wall. Any damage to the wall is therefore eliminated. Moreover, the supporting foot offers the necessary strength to support heavier items without damaging the wall. Finally, the suspension strength of the support device can be varied by increasing or decreasing the number of suction cups which are employed.

BRIEF DESCRIPTION OF THE DRAWINGS

These and other advantages will be clarified in the discussion below with reference to the following drawings in which:

FIG. 1 is a perspective view showing two of the inventive support devices supporting a shelf;

FIG. 2 is a top perspective view of one of the shelf support devices shown in FIG. 1 without a suction cup;

FIG. 3 is a bottom perspective view of a portion of the support device shown in FIG. 2;

FIG. 4 is a side view of the support device shown in FIGS. 1 and 2, but with a suction cup properly engaged;

FIG. 5 is a perspective view of an alternate embodiment of the invention for use with a single suction cup; and FIG. 6 is a side view of the support device shown in FIG. 5 with the suction cup properly engaged.

DETAILED DESCRIPTION OF THE PREFERRED EMBODIMENT

Referring to FIG. 1, two inventive shelf support devices 10 are shown supporting a horizontally positioned glass shelf 12. Each support 10 is suspended by two suction cups 14 which are attached to the wall 15, which may, for example, be a glass window. Each of the supports 10 also has an aperture 16 sized to receive a hanging rod 18. The support device 10, including the suction cups 14, is made of a plastic material with the cups 14 being relatively flexible while the remainder of the device 10 is rigid. The device is therefore lightweight and manufactured at low cost. If the shelf 12 is made of a transparent material, such as glass, advantageously the supports 10, including the suction cups 14, are transparent so as not to be readily visible. Thus, goods which are displayed on the shelf 12 appear to be suspended freely in air to a consumer looking through a store front window. Moreover, the consumer's attention is more directly focused on the goods themselves as opposed to the display fixtures.

Referring to FIGS. 2–4, the support 10 has a top member 20 which projects horizontally outward from the wall 15. The top member 20 has an end 22 distal to the wall 15 and an end 24 proximal to the wall 15. The proximal end 24 is bifurcated into a left arm 26 and a right arm 28. It should be understood that it is not necessary that the distal end 22 be in the same plane as the arms 26,28. Extending downward from each of the arms 26,28 is a yoke-like projection 30 which is essentially parallel to the wall 15. The projections 30 are essentially U-shaped forming a recess 32.

As most clearly shown in FIG. 4, the suction cup 14 has a cap 34 and a knob-like base 36. A neck portion 38 connects the base 36 to the cap 34. The neck portion 38 is sized to fit snugly within the recess 32 of the projection 30. The cap 34 creates a suction against the wall 15, thereby suspending the support device 10 outward from the wall 15. If desired, the top member 20 may have additional arms and projections which engage additional suction cups to increase the suspension strength of the support device 10.

Depending from the top member 20 is a web 40. As most clearly shown in the cross-sectional view of FIG. 3, the web 40 is essentially perpendicular to the top member 20 and bisects its width in a configuration like the upper half of an I-beam. The web 40 interfaces with the top member 20 along its length. Thus, like the top member 20, the web 40 bifurcates into a left arm (not shown) and a right arm 42. When the suction cup 14 is engaged by the yoke-like projection 30, the right arm 42 abuts the cup base 36.

The web 40 angles inward and downward from the distal end 22 of the support device 10 extending into a foot 44 which abuts the wall 15. The foot 44 is formed by a hollowed portion 60 located between the foot 44 and the projection 30. The foot 44 serves to support the top member 20 and the shelf 12. Without the foot 44 abutting the wall 15, the sole means of suspending the support device 10 would be the suction cup 14. Such a device would be unable to support heavier goods, such as shoes. The foot 44, therefore, serves an important support function without damaging the wall 15 as is the case with screws and other similar fastening means.

The use of the suction cups 14 and support foot 44 allows the support device 10 to be easily put up and taken down in a matter of seconds without damage to the wall. The device 10 is therefore completely versatile and can be positioned at any desired location on a wall. Moreover, the support provided by the foot 44 is sufficient to allow the device 10 to support heavier commercial items.

The hollowed portion 60 allows the use of less material in manufacturing the web 40, thereby making the support device 10 lighter in weight and more economical to manufacture. More importantly, if a suction cup 14, having a significantly larger cap than the cap 34 shown is used, the hollowed portion 60 provides space for the cap so that the cup will not prevent the foot 44 from abutting the wall. It also is important that the foot 44 be spaced a sufficient distance below the projection 30 to prevent the cup 14 from interferring with abutment of the foot 44 on the wall.

As most clearly shown in FIG. 4, the foot 44 must extend inwardly toward the wall 15 further than the projection 30 in order for the foot 44 to abut the wall 15. Thus, the foot 44 extends inwardly about as far as the cap 34 of the suction cup 14. Were this not the case, with the cap 34 attached to the wall 15, the foot 44 would be able to abut the wall 15 only with the top member 20 angled downward toward the ground. Such a position would, of course, be unacceptable for a shelf. In fact, it may be preferable to extend the foot 44 in slightly further so that the shelf slopes slightly toward the wall 15, perhaps one or two degrees, to reduce the likelihood of articles sliding off the shelf.

Referring to FIGS. 5 and 6, an alternative embodiment of the invention is shown. A device 45 has a top member 46 having a distal end 48 and a proximal end 50. The proximal end 50 is not bifurcated and thus has a single yoke-like projection 52 extending downward. The projection 52 has a recess 54 which is sized to receive the neck portion 38 of the suction cup 14. A web 56 angles inward and downward from the distal end 48 of the top member 46 forming an elongate foot 58 which abuts the wall 15. As described above, it is important for the foot 58 to extend inward further than the projection 52. As shown in FIG. 6, the foot extends inward as far as the cap 34 of the suction cup 14. Thus, the foot 58 abuts the wall 15 when the top member 46 is in a horizontal position. Located between the projection 52 and the foot 58 is a hollowed portion 60. As clearly shown in FIG. 6, the hollowed portion 60 receives any portion of the cap 34 which extends below the projection 52. Thus, the cap 34 does not interfere with the foot 58 abutting the wall 15. The web 56 also has an aperture 62 for receiving a hanging rod 18 as described above. As should be understood, since this embodiment employs only a single suction cup 14, the strength of the support device 10 is somewhat less than that shown in FIGS. 1–4. Thus, the device, as shown in FIGS. 5 and 6, would be used for lighter items.

I claim:

1. A device for supporting a shelf extending outward from a wall comprising:

(a) a top member having an end proximal to said wall and an end distal to said wall, said member in a horizontal position forming a surface suitable for receiving said shelf;

(b) a U-shaped projection extending downward from said proximal end forming a recess sized to receive a neck portion of a suction cup; and (c) means for supporting said top member depending inward away from said distal end, said supporting means having an elongate foot portion for abutting the wall, said foot portion extending inward further than said U-shaped projection to permit the foot portion to abut the wall when said top member is in a horizontal position.

2. A device for supporting a shelf extending outward from a wall comprising:

(a) a top member having an end distal to the wall and an end proximal to the wall, said proximal end being bifurcated into two arms;

(b) means for engaging a suction cup connected to each of said bifurcated arms; and (c) means for supporting said top member extending downward from said top member, said supporting means having means for abutting the wall, said abutting means extending further inward than said engaging means, and spaced a sufficient distance from said engaging means to permit said cup from interfering with the wall abutment by said abutting means.

3. A device for supporting a shelf extending outward from a wall comprising:

(a) a flat elongate top member having an end proximal to said wall and an end distal to said wall, said member forming a surface suitable for receiving said shelf;

(b) a yolk-like projection extending downward from said proximal end essentially parallel to said wall forming a recess;

(c) a suction cup having a cap portion for engaging the wall and a neck portion sized to fit snugly within said projection; and (d) means for supporting said top member extending downward from and essentially perpendicular to said top member, said supporting means having a foot portion for abutting the wall formed by a hollowed portion between said foot and said projection, said foot extending inward essentially as far as the cap portion of said suction cup when said cup is positioned within said projection to permit said foot to abut the wall when said suction cup is engaged with the wall, said foot being spaced a sufficient distance from said projection to prevent said cup from interfering with the wall abutment of the foot.

4. A device for suspension from a wall by one or more suction cups and for supporting a shelf extending outward from said wall without physically damaging the wall, said device comprising:

(a) a top member having an end proximal to said wall and an end distal to said wall, said member in a substantially horizontal position forming a surface suitable for receiving said shelf;

(b) means attached to said proximal end, engaging a suction cup in a manner which permits said device to be readily disengaged from said cup by simply separating said device from the cup, said suction cup depending below said engaging means;

(c) means for supporting said top member depending inward away from said distal end, said supporting means having an elongate foot portion for abutting the wall, said foot portion extending beyond said engaging means in the direction of the wall and being of a sufficient length to permit said wall abutment when said top member is in said substantially horizontal position, and (d) a recess located between the foot portion and said engaging means, said recess receiving that portion of said suction cup which depends below said engaging means.

5. The device of claims 4, 1, 3 or 2 wherein said device and suction cups are transparent.

* * * * *